US009797229B2

(12) United States Patent
Wingate

(10) Patent No.: US 9,797,229 B2
(45) Date of Patent: Oct. 24, 2017

(54) SETTING THE VALUE OF AN OPERATIONAL PARAMETER OF A WELL

(75) Inventor: John Maclean Wingate, Bristol (GB)

(73) Assignee: GE Oil & Gas UK Limited, Bristol (GB)

( * ) Notice: Subject to any disclaimer, the term of this patent is extended or adjusted under 35 U.S.C. 154(b) by 898 days.

(21) Appl. No.: 13/615,936

(22) Filed: Sep. 14, 2012

(65) Prior Publication Data

US 2013/0068452 A1 Mar. 21, 2013

(30) Foreign Application Priority Data

Sep. 16, 2011 (EP) ..... 11181610

(51) Int. Cl.
*G11B 19/28* (2006.01)
*E21B 43/12* (2006.01)

(52) U.S. Cl.
CPC ..... *E21B 43/12* (2013.01)

(58) Field of Classification Search
CPC ... G11B 5/596; G11B 19/28; G11B 20/10055; G11B 20/10009; G11B 2020/1484; G11B 2020/1284; G01B 11/08; E21B 21/08; E21B 43/12
See application file for complete search history.

(56) References Cited

U.S. PATENT DOCUMENTS 3,677,353 A 7/1972 Baker
3,691,354 A * 9/1972 Green et al. ..... 700/41
4,721,158 A 1/1988 Merritt et al.
4,806,836 A * 2/1989 Webb ..... 318/609
5,544,672 A * 8/1996 Payne et al. ..... 137/1
8,459,285 B2 * 6/2013 Calvert ..... E21B 43/12 137/14
2004/0146331 A1 * 7/2004 McNestry et al. ..... 400/615.2
2008/0027614 A1 * 1/2008 Field et al. ..... 701/60
2009/0173390 A1 * 7/2009 Slupphaug et al. ..... 137/12
2010/0288506 A1 * 11/2010 Lemetayer ..... 166/369
2011/0232966 A1 * 9/2011 Kyllingstad ..... 175/24
2011/0245980 A1 * 10/2011 Nessjoen et al. ..... 700/280
2012/0048620 A1 * 3/2012 Hopwood et al. ..... 175/38
2012/0247831 A1 * 10/2012 Kaasa et al. ..... 175/25
(Continued)

FOREIGN PATENT DOCUMENTS

WO 2009/133343 A1 11/2009

OTHER PUBLICATIONS

"Integral windup", "PID controller" in Wikipedia, 2 pages.*
(Continued)

*Primary Examiner* — Jason Lin
(74) *Attorney, Agent, or Firm* — GE Global Patent Operation

(57) ABSTRACT

A method of setting the value of an operational parameter of a well is provided. The method includes providing a measure related to the actual value of the parameter; setting a maximum limit for the measure; setting a minimum limit for the measure; setting a demanded value for the parameter; and automatically overriding the demanded value if it is such that it would result in the measure exceeding the maximum limit or being below the minimum limit to produce an actual value for the parameter with results in the measure not exceeding the maximum limit and not being below the minimum limit.

18 Claims, 2 Drawing Sheets

(56) References Cited

U.S. PATENT DOCUMENTS

2012/0330466 A1* 12/2012 Rodger ..... E21B 34/02
700/282

OTHER PUBLICATIONS

EP Search Report from corresponding EP Patent Application 11181610.4 Date as Mar. 2, 2012.
Deyu et al., "Research on Smart Well Control System", Journal of Southwest Petroleum Institute, vol. No. 28, Issue No. 4, pp. 97-100, Aug. 2006.
Unofficial English Translation of Chinese Office Action issued in connection with corresponding CN Application No. 201210339348.4 on Dec. 10, 2015.

* cited by examiner

SETTING THE VALUE OF AN OPERATIONAL PARAMETER OF A WELL

BACKGROUND OF THE INVENTION

Embodiments of the present invention relate to setting the value of an operational parameter of a well, such as a hydrocarbon production or injection well.

The safe and efficient operation of an offshore oil or gas well relies on a knowledge of the reservoir characteristics and the ability to control the flow of fluid from the well. The flow of fluid from a reservoir is controlled by means of hydraulically operated valves (or chokes) positioned within the well, usually at the depths of the various reservoir zones, so that fluid can be drawn from each zone as required into the main well borehole. A choke at the wellhead controls the flow of fluid from the well itself. The rate of flow of fluid from a well depends on various parameters, such as the well fluid pressure and the operating conditions, both upstream and downstream. These must be taken into account when determining the optimum flow requirements at any one time and it must also be ensured that the design parameters of the subsea control system and the overall system are not exceeded. For these reasons, a significant amount of operator time is spent manually positioning chokes to optimize production, whilst not exceeding the design and operational limits of the system through which the fluid flows.

Present methods of controlling and determining the choke positions use complex optimization algorithms to set a choke or recommend choke positions to an operator. Maximum and minimum limits are added as constraints to the optimization solution. These algorithms are numerically complex, difficult to tune, and are often not robust to changes in system operation.

BRIEF DESCRIPTION OF THE INVENTION

According to an embodiment of the present invention, a method of setting the value of an operational parameter of a well is provided. The method includes providing a measure related to the actual value of the parameter; setting a maximum limit for the measure; setting a minimum limit for the measure; setting a demanded value for the parameter; and automatically overriding the demanded value if it is such that it would result in the measure exceeding the maximum limit or being below the minimum limit to produce an actual value for the parameter which results in the measure not exceeding the maximum limit and not being below the minimum limit.

According to another embodiment of the present invention, a control system of a well, for setting the value of an operational parameter of the well is provided. The control system includes a sensor configured to provide a measure related to the actual value of said parameter, the control system being configured to: set a maximum limit for the measure; set a minimum limit for the measure; set a demanded value for the parameter; and automatically override the demanded value if it is such that it would result in the measure exceeding the maximum limit or being below the minimum limit to produce an actual value for the parameter which results in the measure not exceeding the maximum limit and not being below the minimum limit.

DETAILED DESCRIPTION OF THE EXEMPLARY EMBODIMENTS OF THE INVENTION

Figure 1:
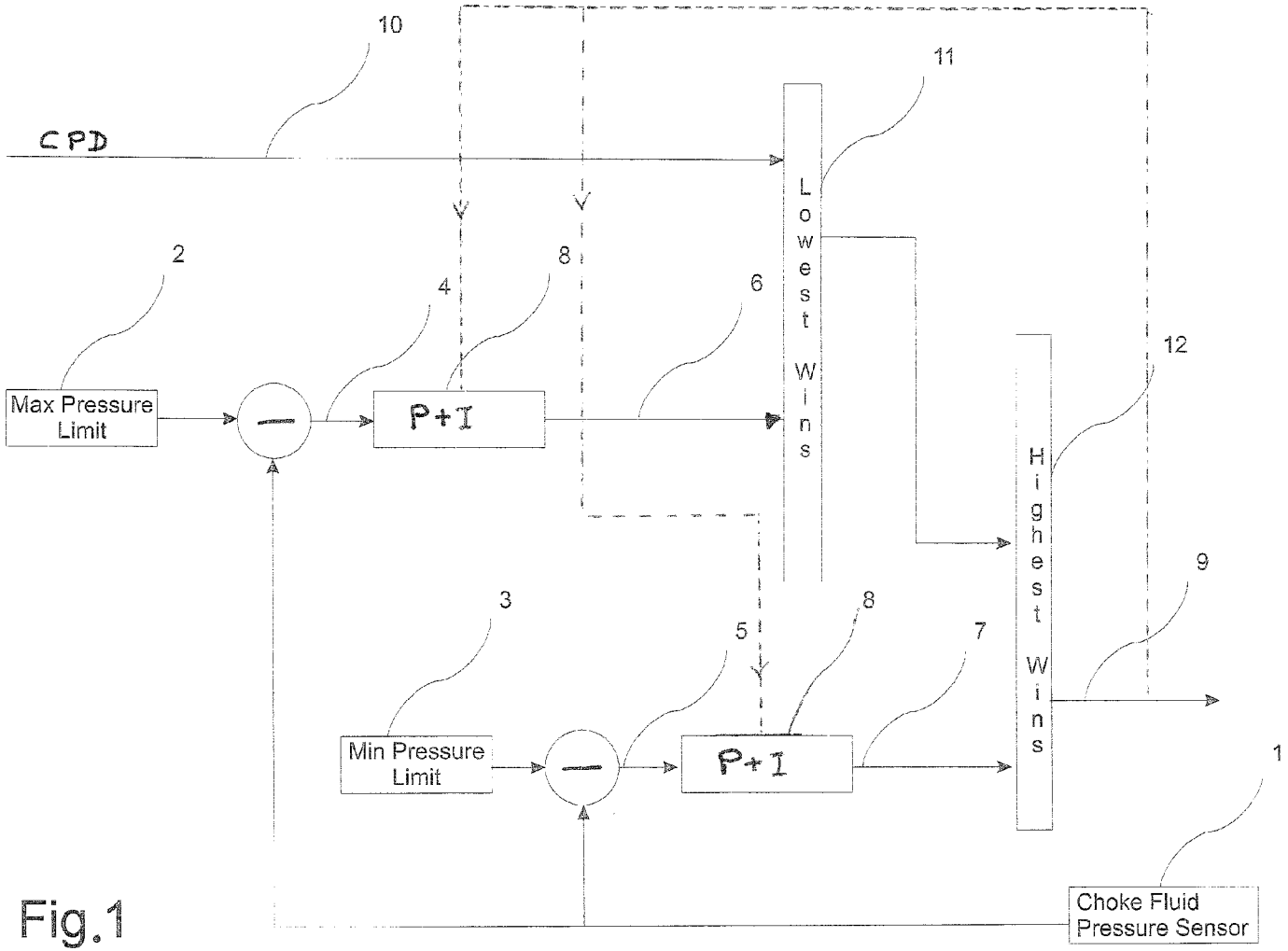
FIG. 1 shows a block diagram illustrating a control system according to an embodiment of the present invention.

An embodiment of the present invention is shown in FIG. 1, comprising a control system of a hydrocarbon production or injection well, which system uses an algorithm to automatically limit manual and/or automatic choke demands of a subsea production or injection choke, to ensure that a maximum fluid pressure is not exceeded and a minimum fluid pressure is not dropped below. In the embodiment, the operational parameter is the position of a choke and the measure related to the actual value of the parameter is choke fluid pressure.

Referring to FIG. 1, feedback of the actual fluid pressure at a choke is provided by a choke fluid pressure sensor 1. This is compared with a maximum pressure limit 2 and a minimum pressure limit 3 and, in each case, an error (pressure difference) is calculated, to provide a maximum loop error 4 and a minimum loop error 5 respectively. By means of a proportional plus integral (P & I) function 8 in each case, these errors are converted to a maximum loop choke (position) demand 6 (i.e. a first value for the position of the choke, which decreases as choke position demand decreases) and a minimum loop choke (position) demand 7 (i.e. a second value for the position of the choke, which increases as choke position demand increases). Each function it acts as a so-called "anti-wind-up function", the function 8 takes into account an actual choke (position) demand 9, in order to achieve this.

When the choke fluid pressure sensed by sensor 1 is equal to the maximum pressure limit 2, the maximum loop error 4 is zero and when the choke fluid pressure sensed by the sensor 1 equals the minimum pressure limit 3, the minimum loop error 5 is zero. In each case the demand (6 or 7) will equal a lagged version of the demand 9.

The choke position demand (CPD) 10, which may be automatically set or may be set by an operator manually, is compared initially with the maximum loop choke demand 6, and on the basis of lowest wins logic 11, it will only be allowed through unchanged if it will move the choke to a position which results in the choke fluid pressure sensed by sensor 1 being below the maximum pressure limit 2. Otherwise, the maximum demand 6 passed through.

The output of logic 11 is then compared with the minimum choke loop demand 7 in highest logic wins 12 and it will be allowed through if it moves the choke to a position which results in the choke fluid pressure sensed by sensor 1 being above the minimum pressure limit 3. Otherwise the minimum demand 7 is passed through.

Figure 2:
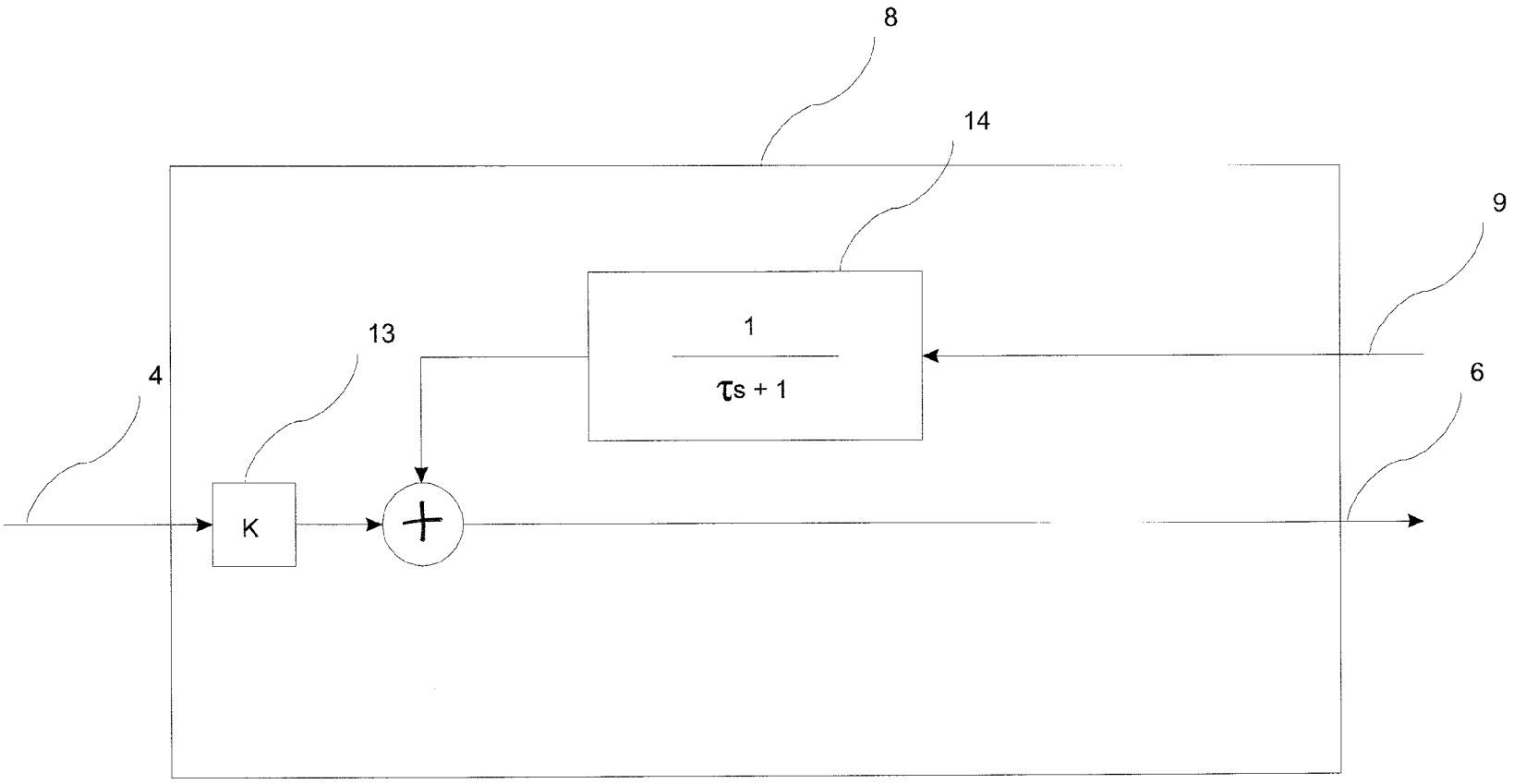
FIG. 2 shows a detail of one of the blocks of FIG. 1.

The transfer function applied by each proportional plus integral (anti-wind-up) function 8, which converts the loop error signal (pressure) to a choke position demand signal, is shown diagrammatically in FIG. 2 in relation to the maximum loop error 4, a similar situation arising for the minimum loop error 5. The function 8 is provided by a proportional controller 13 plus an integral controller 14. The block functions as a traditional proportional plus integral (P+I) controller, providing phase advance and ensuring zero steady state error between the maximum and minimum pressure limits, based on the pressure sensor feedback. More particularly, the loop error is multiplied by a constant factor (K) to result in a proportional (maximum or minimum) loop error which is added to a dynamically lagged version of the actual demand 9. If in each case the loop error 4 or 5 is large, the respective block 8 behaves like a simple gain based on K, the system being in a "passive" mode and the integral controller 14 of the block 8 being inactive. However, the design of each block 8 is such that, if the respective loop error 4 or 5 decreases to a particular, predetermined level since the sensed pressure is approaching the maximum or minimum limit, then the controller 14 becomes active, the system being in an "active" mode, to prevent that pressure exceeding the maximum limit or falling below the minimum limit.

Therefore, provided that the choke position demand results in a feedback pressure within the maximum and minimum limits, the system will allow the demand to pass through unchanged. Only when the position of the choke is such that the maximum limit is about to be exceeded or is about to be below the minimum limit will the system override the choke demand. The limits are applied such that the final choke demand does not exceed well or equipment limits.

According to embodiments of the present invention, overriding a demand could include comparing the measure with the maximum limit and producing a first value for the parameter from a maximum limit error between the measure and the maximum limit, the method being such that the first value increases as the demanded value increases so that, if the demanded value would result in the measure being at the maximum limit, the first value would result in the measure being at the maximum limit. Overriding a demand could further include selecting the lower of the demanded value and the first value. Overriding a demand could also include comparing the measure with the minimum limit and producing a second value for the parameter from a minimum limit error between the measure and the minimum limit, the method being such that the second value decreases as the demanded value decreases so that, if the demanded value would result in the measure being at the minimum limit, the second value would result in the measure being at the minimum limit. Override a demand could further include setting the actual value of the parameter as the higher of the first and second values.

According to embodiments of the present invention, the first value may be produced by multiplying the maximum limit error by a constant factor to result in a proportional maximum limit error that is added to a dynamically lagged version of the actual demanded value; and the second value may be produced by multiplying the minimum limit error by a constant factor to result in a proportional minimum limit error that is added to a dynamically lagged version of the actual demanded value.

The operational parameter may be a parameter of an actuatable member, for example a choke. The measure related to the actual value of the parameter could be fluid pressure at the member, the parameter being a position of the member.

In embodiments of the present invention the well may be a hydrocarbon production or injection well.

According to one embodiment of the present invention an algorithm is used to automatically limit manual or automatic choke demands of a subsea production or injection choke. The limits may be applied such that the final choke demand does not result in maximum and, minimum well or equipment limits being exceeded or dropped below respectively.

Embodiments of the present invention provide a technically simple and robust method of determining the optimum position of a choke, to enable an operator to control hydrocarbon fluid flow from a well and therefore optimize the production rates across a range of flow conditions, while still ensuring that design and operational parameters are not exceeded. The method includes employing a closed loop algorithm, which provides the capability to maintain the limits in the face of changing flow conditions. The algorithm can be implemented by suitable hardware such as a programmable logic device or by software operating in a processor. Other limits that could be applied using embodiments of the present invention, subject to instrumentation being in place, include a well draw down limit; downstream equipment maximum and minimum pressure limits; and downstream equipment maximum and minimum flow rates.

A computer program adapted for carrying out a method according to embodiments of the present invention is also provided.

The following is a description of how the above embodiment could be used.

Consider the following situation. An engineer managing production from an oil well controls the flow and pressure output of the well by manually setting the position of a production choke. In doing so, he tries to ensure that various physical limits associated with the well and its associated equipment are not exceeded. Say, for example, the pressure downstream of the choke must be kept below 150 bar. During a particular production run the engineer has set a particular choke position that results in a downstream pressure of 100 bar. As the production run continues he might gradually open (increase the lift) the choke to result in the downstream pressure exceeding 150 bar and potentially damaging the downstream pipework.

Now consider the situation with the above system in place. In this situation, the lift of the choke is normally set by the production engineer. As he gradually manually increases the lift, the well's downstream pressure will increase. As the downstream pressure approaches the limit (150 bar), the system will become active and override the engineer's manual choke commands. The system algorithm will then derive the choke lift to maintain the downstream pressure at 150 bar regardless of the manual command to increase the lift. Likewise, the system prevents the downstream pressure falling below a minimum limit as the demand is decreased but keeps it at the minimum limit if necessary. The algorithm uses an integral closed loop control to derive the choke lift necessary to stop the pressure exceeding the 150 bar limit, or failing below the minimum limit. This integral closed loop control algorithm operates in two modes, active and passive. In the active mode, the integral controller is operational and in passive mode the engineer is setting the command manually. The anti-wind-up logic ensures that the transition from passive to acme mode is smooth bump free and happens at the right time, i.e. at predetermined points before the downstream pressure reaches the maximum or minimum limits.

Embodiments of the present invention: enable a technically simple implementation and tuning which is robust across a set of flow conditions; allow the operator to set the choke position in the knowledge that the algorithm will protect against over/under positioning of the choke; could be used in isolation as a limiter to over-ride manual set-points or placed in series with other closed loop control algorithms; and can be adapted to implement a set of limits and is not restricted to simple maximum and/or minimum limits but can combine pressure, flow, temperature limits if needed. Commercially it adds important safety features and opportunity for an operator to optimize production rates.

Thus, while there has been shown and described and pointed out fundamental novel features of the invention as applied to exemplary embodiments thereof, it will be understood that various omissions and substitutions and changes in the form and details of the devices illustrated, and in their operation, may be made by those skilled in the art without departing from the spirit of the invention. Moreover, it is expressly intended that all combinations of those elements and/or method steps which perform substantially the same function in substantially the same way to achieve the same results are within the scope of the invention. Furthermore, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A method of setting a value of an operational parameter of a well, the method comprising:

providing a measure related to an actual value of the parameter;

setting a maximum limit for the measure;

setting a minimum limit for the measure;

setting a demanded value for the parameter; and automatically overriding the demanded value if it is such that it would result in the measure exceeding the maximum limit or being below the minimum limit to produce a value for the demanded value for the parameter which results in the measure not exceeding the maximum limit and not being below the minimum limit, wherein automatically overriding the demanded value comprises:

comparing the measure with the maximum limit and producing a first value for the parameter from a maximum limit error between the measure and the maximum limit, wherein the first value increases as the demanded value increases so that, if the demanded value would result in the measure being at or above the maximum limit, the first value would result in the measure being at the maximum limit;

producing a new first value by comparing the demanded value and the first value and selecting the lower of the demanded value and the first value;

comparing the measure with the minimum limit and producing a second value for the parameter from a minimum limit error between the measure and the minimum limit, wherein the second value decreases as the demanded value decreases so that, if the demanded value would result in the measure being at or below the minimum limit, the second value would result in the measure being at the minimum limit; and setting the value for the demanded value for the parameter as the higher of the first new value and the second value.

2. The method according to claim 1, wherein:

the first value is produced by multiplying the maximum limit error by a constant factor to result in a proportional maximum limit error that is added to a dynamically lagged version of the actual demanded value.

3. The method according to claim 2, further comprising wherein the second value is produced by multiplying the minimum limit error by a constant factor to result in a proportional minimum limit error that is added to a dynamically lagged version of the actual demanded value.

4. The method according to claim 1, wherein the operational parameter is a parameter of an actuatable member.

5. The method according to claim 4, wherein the member comprises a choke.

6. The method according to claim 4, wherein the measure related to the actual value of the parameter is fluid pressure at the member, the parameter being a position of the member.

7. The method according to claim 1, wherein the well is a hydrocarbon production or injection well.

8. The method according to claim 1, wherein the second value is produced by multiplying the minimum limit error by a constant factor to result in a proportional minimum limit error that is added to a dynamically lagged version of the actual demanded value.

9. A control system of a well, for setting the value of an operational parameter of the well, the system comprising:

a sensor configured to provide a measure related to the actual value of the parameter, the control system being configured to:

set a maximum limit for the measure;

set a minimum limit for the measure;

set a demanded value for the parameter; and automatically override the demanded value if it is such that it would result in the measure exceeding the maximum limit or being below the minimum limit to produce a value for the demanded value of the parameter which results in the measure not exceeding the maximum limit and not being below the minimum limit, wherein automatically overriding the demanded value comprises:

comparing the measure with the maximum limit and producing a first value for the parameter from a maximum limit error between the measure and the maximum limit, wherein the first value increases as the demanded value increases so that, if the demanded value would result in the measure being at or above the maximum limit, the first value would result in the measure being at the maximum limit;

producing a new first value by comparing the demanded value and the first value and selecting the lower of the demanded value and the first value;

comparing the measure with the minimum limit and producing a second value for the parameter from a minimum limit error between the measure and the minimum limit, wherein the second value decreases as the demanded value decreases so that, if the demanded value would result in the measure being at or below the minimum limit, the second value would result in the measure being at the minimum limit; and setting the value for the demanded value for the parameter as the higher of the first new value and the second value.

10. The control system according to claim 9 being further configured to: produce the first value by multiplying the maximum limit error by a constant factor to result in a proportional maximum limit error that is added to a dynamically lagged version of the actual demanded value; and produce the second value by multiplying the minimum limit error by a constant factor to result in a proportional minimum limit error that is added to a dynamically lagged version of the actual demanded value.

11. The control system according to claim 9, wherein the operational parameter is a parameter of an actuatable member.

12. The control system according to claim 11, wherein the member comprises a choke.

13. The control system according to claim 11, wherein the measure related to the actual value of the parameter is fluid pressure at the member, the parameter being a position of the member.

14. The control system according to claim 9, wherein the well is a hydrocarbon production or injection well.

15. The method according to claim 9, wherein the second value is produced by multiplying the minimum limit error by a constant factor to result in a proportional minimum limit error that is added to a dynamically lagged version of the actual demanded value.

16. A method of setting the value of an operational parameter of a well, the method comprising:

providing a measure related to the actual value of the parameter;

setting a maximum limit for the measure;

setting a minimum limit for the measure;

setting a demanded value for the parameter; and automatically overriding the demanded value if it is such that it would result in the measure exceeding the maximum limit or being below the minimum limit, wherein automatically overriding the demanded value comprises:

comparing the measure with the maximum limit and producing a first value for the parameter from a maximum limit error between the measure and the maximum limit, wherein the first value increases as the demanded value increases so that, if the demanded value would result in the measure being at or above the maximum limit, the first value would result in the measure being at the maximum limit;

producing a new first value by comparing the demanded value and the first value and selecting the lower of the demanded value and the first value;

comparing the measure with the minimum limit and producing a second value for the parameter from a minimum limit error between the measure and the minimum limit, wherein the second value decreases as the demanded value decreases so that, if the demanded value would result in the measure being at or below the minimum limit, the second value would result in the measure being at the minimum limit; and setting the value for the demanded value for the parameter as the higher of the first new value and the second value.

17. The method of claim 16, wherein if the demanded value results in the measure exceeding the maximum limit or being below the minimum limit, automatically overriding the demanded value comprises:

maintaining the actual measured value of the parameter.

18. The method of claim 16, wherein if the demanded value results in the measure exceeding the maximum limit or being below the minimum limit, automatically overriding the demanded value comprises:

not adjusting the actual measured value of the parameter based upon the demanded value.

* * * * *